US009970130B2

(12) United States Patent
Kang et al.

(10) Patent No.: US 9,970,130 B2
(45) Date of Patent: May 15, 2018

(54) CARBON NANOFIBERS WITH SHARP TIP ENDS AND A CARBON NANOFIBERS GROWTH METHOD USING A PALLADIUM CATALYST

(71) Applicant: KOREA INSTITUTE OF SCIENCE AND TECHNOLOGY, Seoul (KR)

(72) Inventors: JungHo Kang, Wanju-gun (KR); Myung Jong Kim, Wanju-gun (KR); Dong Su Lee, Wanju-gun (KR)

(73) Assignee: Korea Institute of Science and Technology, Seoul (KR)

( * ) Notice: Subject to any disclaimer, the term of this patent is extended or adjusted under 35 U.S.C. 154(b) by 237 days.

(21) Appl. No.: 14/808,683

(22) Filed: Jul. 24, 2015

(65) Prior Publication Data

US 2016/0102420 A1 Apr. 14, 2016

(30) Foreign Application Priority Data

Oct. 10, 2014 (KR) ..... 10-2014-0136903

(51) Int. Cl.
*D01F 9/127* (2006.01)

(52) U.S. Cl.
CPC ..... *D01F 9/127* (2013.01)

(58) Field of Classification Search
CPC ..... D01F 9/1273; D01F 9/127; D01F 9/10; D01F 9/1271; D01F 9/1272; D01F 9/1274; D01F 9/1275; D01F 9/1276; D01F 9/1277; D01F 9/1278; C01B 31/022; C01B 31/0226; C01B 31/0233; C01B 31/024; C01B 31/0246; C01B 31/0253; C01B 31/026; C01B 31/0266; C01B 31/0273; C01B 31/028; C01B 31/0286;

(Continued)

(56) References Cited

U.S. PATENT DOCUMENTS 7,779,163 B2 * 8/2010 Franchuk ..... G05B 19/4148 709/250
7,799,163 B1 * 9/2010 Mau ..... B82Y 10/00 156/230

(Continued)

FOREIGN PATENT DOCUMENTS

KR 10-2008-0039227 5/2008

OTHER PUBLICATIONS

Erikson, et al., Oxygen reduction on Nafion-coated thin-film palladium electrodes, Journal of Electroanalytical Chemistry 2011; 652: 1-7.*

(Continued)

*Primary Examiner* — Daniel C McCracken
(74) *Attorney, Agent, or Firm* — Greer Burns & Crain Ltd.

(57) ABSTRACT

The present invention relates to a carbon nanofibers growth method including (S1) depositing an alumina layer on a silicon substrate, (S2) depositing palladium on the alumina layer to form a palladium catalyst layer, and (S3) growing carbon nanofibers on the palladium catalyst layer by a chemical vapor deposition (CVD) method, and carbon nanofibers vertically grown on an alumina layer-deposited silicon substrate, the carbon nanofibers having tip ends with a radius of curvature less than or equal to 5 nm, a diameter less than or equal to 50 nm, a length more than or equal to 1 mm, and a length-diameter aspect ratio more than or equal to 50,000.

10 Claims, 5 Drawing Sheets

(58) Field of Classification Search
CPC ..... C01B 31/0293; C01B 2202/02; C01B 2202/06; C01B 2202/08; C01B 2202/10; C01B 2202/20; C01B 2202/22; C01B 2202/24; C01B 2202/26; C01B 2202/28; C01B 2202/30; C01B 2202/32; C01B 2202/34; C01B 2202/36; C01B 2202/00; B82Y 5/00; B82Y 10/00; B82Y 15/00; B82Y 20/00; B82Y 25/00; B82Y 30/00; B82Y 35/00; B82Y 40/00; B82Y 99/00
See application file for complete search history.

(56) References Cited

U.S. PATENT DOCUMENTS

| | | | |
|---|---|---|---|
| 8,277,872 | B1 | 10/2012 | Al-Haik et al. |
| 2009/0004095 | A1 | 1/2009 | Yoon et al. |
| 2009/0191116 | A1 | 7/2009 | Yoon et al. |
| 2010/0202958 | A1 | 8/2010 | Yoon et al. |

OTHER PUBLICATIONS

Wong, et al., Carbon nanotubes field emission devices grown by thermal CVD with palladium as catalysts, Diamond & Related Materials 2004; 2105-2112.*

Hoffmann, et al., Low-termperature growth of carbon nanotubes by plasma-enhanced chemical vapor deposition, Appl. Phys. Lett. 2003; 83(1): 13-137.*

H. Terrones et al.; "Graphite cones in palladium catalysed carbon nanofibers"; Chemical Physics Letters 343 (2001); pp. 241-250; Aug. 3, 2001.

Ngo et al.; "Palladium catalyzed formation of carbon nanofibers by plasma enhanced chemical vapor deposition"; ScienceDirect; Carbon 45 (2007); pp. 424-428.

Myung Jon Kim et al.; "Efficient Transfer of a VA-SWNT Film by a Flip-Over Technique"; J. Am. Chem. Soc. vol. 128, No. 29; pp. 9312-9313; 2006.

* cited by examiner

FIG.3(a)
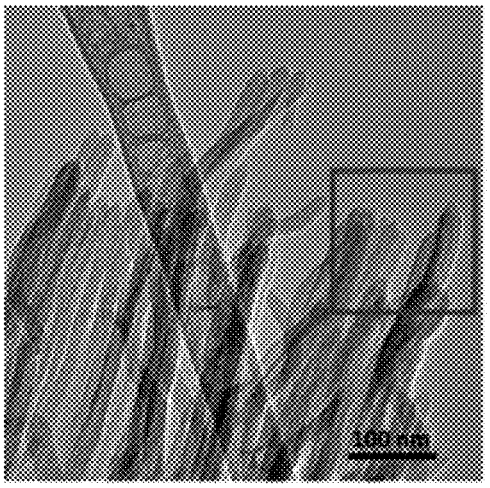
FIG.3(b)
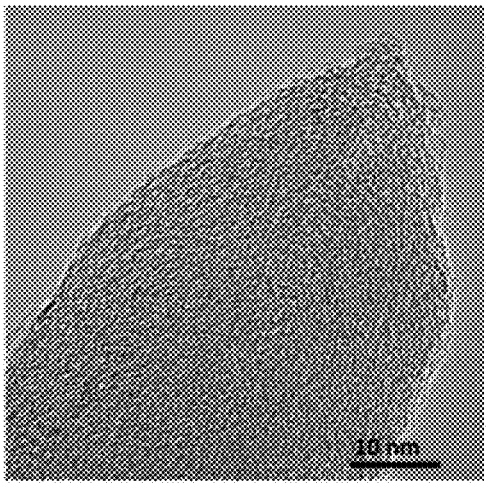
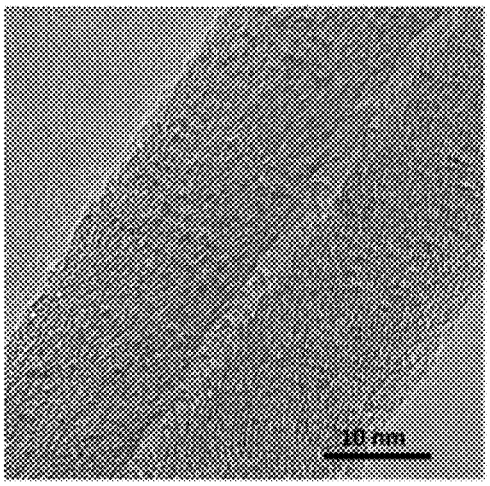
FIG.3(c)
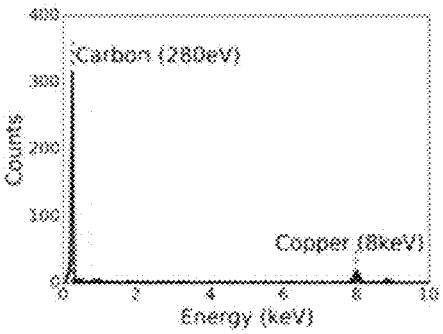
FIG.3(d)

CARBON NANOFIBERS WITH SHARP TIP ENDS AND A CARBON NANOFIBERS GROWTH METHOD USING A PALLADIUM CATALYST

TECHNICAL FIELD

The present disclosure relates to carbon nanofibers with sharp tip ends and a carbon nanofibers growth method using a palladium catalyst, and more particularly, to carbon nanofibers of a very sharp tip structure with a radius of curvature of the tip less than or equal to 5 nm and a carbon nanofibers growth method for vertically growing millimeter-scale carbon nanofibers on a silicon substrate by a chemical vapor deposition (CVD) method using palladium as a catalyst.

BACKGROUND ART

Carbon nanofibers are a considerably different material in structure and size from carbon fibers being widely used at present. Carbon nanofibers have a similar size to multi-walled carbon nanotubes but a different structure from them. Carbon nanotubes are constructed of $sp^2$ bonded carbon atomic layers of a hexagonal shape, the carbon atomic layers arranged in layers in cylindrical form parallel to the axial direction, while carbon nanofibers have a structure in which identical carbon atomic layers are stacked forming an angle with the axial direction.

Although carbon nanofibers do not have higher tensile strength and electrical conductivity than carbon nanotubes, carbon nanofibers have a structure in which edges of each carbon atomic layer are exposed outside, so they are suitable as nanomaterials requiring a high surface energy.

For several tens nanometer scale growth mechanism of carbon nanotubes and carbon nanofibers using a catalytic chemical vapor deposition (CVD) method, Baker has discovered that bulk diffusion of carbon atoms is a factor critical in determining a final length or a reaction rate.

There are many carbon nanofibers growth methods, and a carbon nanofibers growth method using a most general CVD method is summarized as follows:

(a) Above a metal catalyst where hydrocarbon gas such as ethylene or methane is deposited on the surface, carbon and hydrogen separate, and hydrogen in gaseous state escapes, with only carbon atoms left.

(b) The carbon atoms are accumulated within catalyst particles by diffusion, and when the catalyst particles exceed the limit of capabilities of accommodating carbon atoms, the carbon atoms are accumulated on the surface of the catalyst particles.

(c) When carbon atoms are continuously supplied to the surface of the catalyst particles, carbon nanofibers are grown.

A method of producing carbon nanofibers using a catalyst includes a method using a floating (not fixed) catalyst and a method using a catalyst supported on a substrate, and if a method using a catalyst supported on a substrate is used, carbon nanofibers may be grown vertically like trees in the forest. Generally, the thickness of carbon nanofibers depends on a catalyst particle size, and a catalyst is present at one end part of carbon nanofibers and continuously synthesizes carbon nanofibers during activation.

Generally, when iron is used as a catalyst, carbon nanotubes rather than carbon nanofibers are formed, and it is thought that it is because both bulk diffusion and surface diffusion are concurrently active. A metal that does not instigate bulk diffusion as strongly as iron but comes off second best is palladium. It is reported that if palladium is used, primarily carbon nanofibers rather than carbon nanotubes are synthesized, and if plasma is used together, synthesis is accomplished much more easily.

There have been many reports on vertically grown millimeter-scale carbon nanotubes with a very high aspect ratio, but vertically grown carbon nanofibers with a very aspect ratio have not been reported so far.

DISCLOSURE

Technical Problem

The present disclosure is designed to providing vertically grown millimeter-scale carbon nanofibers with a very high aspect ratio prepared economically and efficiently by growing carbon nanofibers on a silicon substrate by a chemical vapor deposition (CVD) method using palladium as a catalyst, and a preparation method thereof.

Technical Solution

To achieve the object, according to one aspect of the present disclosure, there is provided a carbon nanofibers growth method including (S1) depositing an alumina layer on a silicon substrate, (S2) depositing palladium on the alumina layer to form a palladium catalyst layer, and (S3) growing carbon nanofibers on the palladium catalyst layer by a chemical vapor deposition (CVD) method.

In this instance, the alumina layer may be deposited with a thickness larger than or equal to 5 nm.

The palladium catalyst layer may be formed with a thickness of from 0.5 nm to 5 nm.

The carbon nanofibers growth method may, between the step S2 and the step S3, further include removing impurities created on the palladium catalyst layer.

The carbon nanofibers growth method may, between the step S2 and the step S3, further include granulating the deposited palladium.

Here, the granulating of the deposited palladium may include mixing and supplying hydrogen gas and argon gas to the deposited palladium, and heating at the temperature of from 500° C. to 800° C. in a vacuum or normal pressure condition.

The step S3 may be performed in a vacuum or normal pressure condition with a carbon source, hydrogen gas and argon gas mixed and supplied to the deposited palladium.

In this instance, the carbon source may be any one selected from the group consisting of ethylene gas, methane gas, acetylene gas, benzene, acetone, and alcohol, or mixtures thereof.

The step S3 may be performed in a heated state at the temperature of from 600° C. to 900° C.

In this instance, the heating may be performed by any one selected from inductive heating, microwave heating, plasma heating, resistance heating, and laser heating.

According to another aspect of the present disclosure, there are provided carbon nanofibers vertically grown on an alumina layer-deposited silicon substrate, the carbon nanofibers having tip ends with a radius of curvature less than or equal to 5 nm, a diameter less than or equal to 50 nm, a length more than or equal to 1 mm, and a length-diameter aspect ratio more than or equal to 50,000.

Advantageous Effects

The carbon nanofibers formed by a carbon nanofibers growth method according to one embodiment of the present disclosure have tip ends with a radius of curvature less than or equal to 5 nm, a diameter less than or equal to 50 nm, a length more than or equal to 1 mm, and a length-diameter aspect ratio more than or equal to 50,000, and accordingly, the carbon nanofibers may be used as not only field emission electronic materials using their features of length and tip shape, but also battery or super capacitor materials using their high reactivity of a high density edge structure exposed outside and atomic force microscope tips using their sharp tips.

Further, the carbon nanofibers growth method according to one embodiment of the present disclosure easily achieves large-scale growth, and may be applied to composite materials and atomic force microscope cantilever probes where carbon nanofibers are currently used.

BRIEF DESCRIPTION OF THE DRAWINGS

FIG. 3(*a*) is a transmission electron microscopy (TEM) image of carbon nanofibers prepared according to one embodiment of the present disclosure.

FIG. 3(*b*) is a TEM image of a sharp tip end of carbon nanofibers prepared according to one embodiment of the present disclosure.

FIG. 3(*c*) is a TEM image of a middle part of carbon nanofibers prepared according to one embodiment of the present disclosure.

FIG. 3(*d*) is an energy dispersive X-ray (EDX) graph showing elemental analysis of carbon nanofibers prepared according to one embodiment of the present disclosure.

MODE FOR CARRYING OUT THE INVENTION

Figure 1:
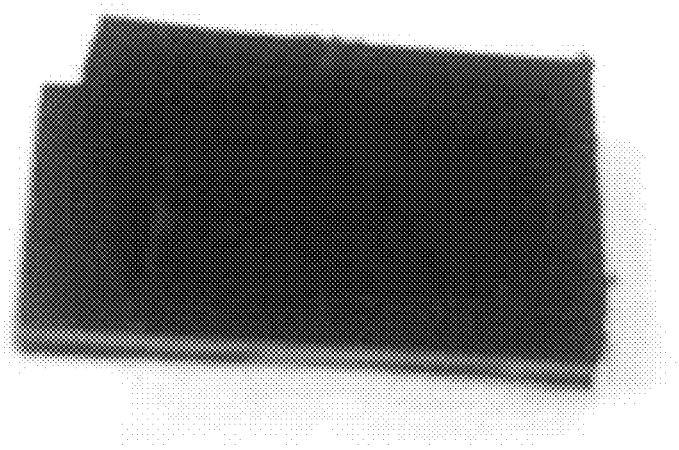
FIG. 1 is a photographic image of carbon nanofibers vertically grown up to 2 mm in height on a silicon substrate prepared according to one embodiment of the present disclosure.

Hereinafter, the present disclosure is described in detail. It should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

The description proposed herein is just a preferable example for the purpose of illustrations only, not intended to limit the scope of the disclosure, so it should be understood that other equivalents and modifications could be made thereto without departing from the spirit and scope of the disclosure.

The present disclosure encompasses a method of vertically growing carbon nanofibers on a substrate having palladium as a catalyst deposited thereon by using high carbon diffusivity of palladium without plasma, the carbon nanofibers having an aspect ratio approximately 1,000 times higher than a related art.

The carbon nanofibers growth method according to one embodiment of the present disclosure includes (S1) depositing an alumina layer on a silicon substrate; (S2) depositing palladium on the alumina layer to form a palladium catalyst layer; and (S3) growing carbon nanofibers on the palladium catalyst layer by a chemical vapor deposition (CVD) method.

As opposed to a traditional other methods, the carbon nanofibers growth method according to the present disclosure eliminates the need for a plasma, enables efficient preparation at a low cost by using a CVD method being widely used, and is advantageous in mass production.

Also, carbon nanofibers formed by the method have no catalyst particle found at the tip ends, and thus have a very high length-diameter aspect ratio and a very sharp tip structure. So the carbon nanofibers may be used as electronic materials for field emission and batteries and capacitors, and may be used to make very sharp probes by attaching to cantilever tips of atomic force microscopes designed for nanoscale surface observation.

According to the present disclosure, because the alumina layer deposited on the silicon substrate is used as a catalyst support, base growth is achieved, not tip growth, and as a result, carbon nanofibers have sharp tips.

In this instance, a silica ($SiO_2$) layer having a thickness ranging from 200 nm to 300 nm may be formed on the silicon substrate, and the alumina layer may be deposited thereon.

If the alumina layer is too thin, it is unfavorable for film formation, so the alumina layer is preferably deposited with a thickness more than or equal to 5 nm.

Preferably, the palladium catalyst layer is formed with a thickness ranging from 0.5 nm to 5 nm to form nanoparticles when subjected to thermal treatment later.

The method may further include, between the step S2 and the step S3, removing impurities created on the palladium catalyst layer.

On the palladium catalyst layer, remaining carbon and many organic materials affecting the action of the catalyst may be created, and to remove such impurities, it is preferred to heat at about 500° C. in the air for about 5 minutes to 20 minutes.

The method may further include, between the step S2 and the step S3, granulating the deposited palladium.

In this instance, the granulating step may include heating the deposited palladium in a vacuum condition at the temperature ranging from 500° C. to 800° C. Here, the vacuum condition includes a perfect vacuum condition and a low atmospheric pressure condition of about 10 mtorr.

After the heating, an additional step may be performed, in which hydrogen gas and argon gas is mixed and supplied to the deposited palladium at 300 sccm to 500 sccm and 500 sccm to 700 sccm, respectively, and heating at the temperature ranging from 500° C. to 800° C. in the vacuum or normal pressure condition. In this instance, the heating time is preferably about 5 minutes.

This process is called Ostwald ripening, and is a process of granulating the palladium catalyst to a suitable size to grow the carbon nanofibers.

The step S3 may be performed in the vacuum or normal pressure condition with a carbon source, hydrogen gas and argon gas mixed and supplied to the deposited palladium at 50 sccm to 150 sccm, 300 to 500 sccm, and 400 sccm to 600 sccm, respectively.

Here, the carbon source is a source for supplying carbon atoms necessary to grow carbon nanofibers, may include, but is not limited to, ethylene gas, methane gas, acetylene gas, benzene, acetone, and alcohol.

The hydrogen gas prevents the palladium particles from losing their function as a catalyst by coating the palladium catalyst layer with carbon atoms.

In this instance, the step S3 may be performed for 30 minutes or longer in the heated at the temperature ranging from 600° C. to 900° C.

Here, the heating may be performed by inductive heating, microwave heating, plasma heating, resistance heating, and laser heating.

When the carbon nanofibers growth method according to the present disclosure is performed, vertically grown rigid carbon nanofibers are obtained, and carbon nanofibers having tip ends with a radius of curvature less than or equal to 5 nm, a diameter less than or equal to 50 nm, a length more than or equal to 1 mm, and a length-diameter aspect ratio more than or equal to 50,000 may be obtained. The vertically grown millimeter-scale carbon nanofibers have not been reported yet.

Hereinafter, the present disclosure will be described in detail through examples to particularly describe the present disclosure. The embodiments of the present disclosure, however, may be modified in several other forms, and the scope of the present disclosure should not be construed as being limited to the following examples. The embodiments of the present disclosure are provided to more fully explain the present disclosure to those having ordinary knowledge in the art to which the present disclosure pertains.

EXAMPLE

First, a general silicon substrate covered with an oxide layer (silica layer) having a thickness of from 200 nm to 300 nm was cleaned in isoprophyl alcohol twice by ultrasonic cleaning, and after that, was washed with deionized water to remove impurities from the surface.

Subsequently, a 10 nm thick alumina layer and a 1 nm thick palladium catalyst layer were formed on the silicon substrate in a sequential order using an e-beam evaporator.

Subsequently, the substrate having the deposited palladium catalyst layer was heated at 500° C. in the air for 10 minutes, to remove many impurities attached on the surface.

Subsequently, after heating to 780° C. in a vacuum chamber of about 10 mtorr, hydrogen gas and argon gas was supplied at 400 sccm and 600 sccm, respectively, and when it reached the normal pressure, heating was performed for 5 minutes, keeping an exhaust open.

Again, after creating a vacuum of about 10 mtorr inside the chamber, ethylene ($C_2H_4$) gas, hydrogen gas, and argon gas was supplied at 100 sccm, 400 sccm, and 500 sccm, respectively, and a reaction proceeded for 40 minutes when it reached the normal pressure.

After the synthesis reaction ends, cooling is performed while maintaining the internal chamber in vacuum, and a substrate with vertically grown carbon nanofibers was separated.

Experiment 1

Electron Microscopy Analysis of Carbon Nanofibers

Figure 2:
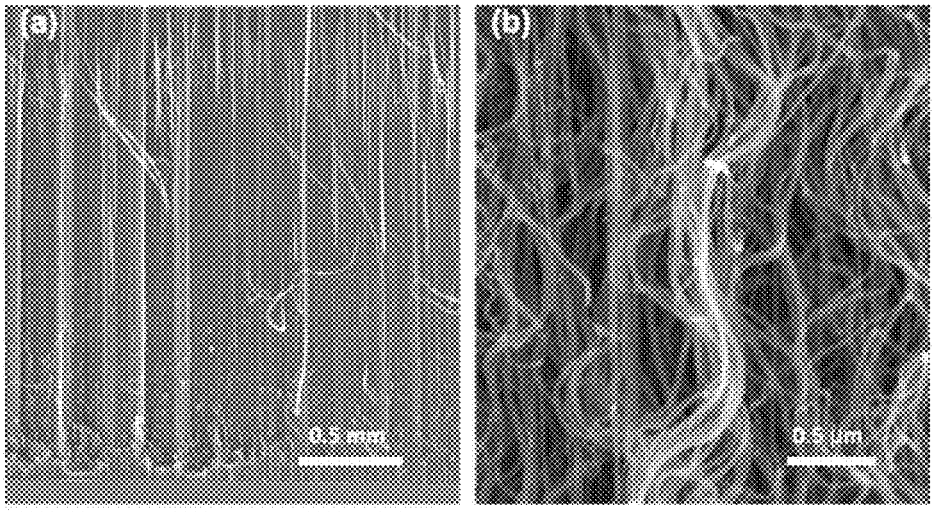
FIG. 2 is an electron microscopy image of carbon nanofibers prepared according to one embodiment of the present disclosure.

To analyze the carbon nanofibers grown from the example using an electron microscope, the substrate with vertically grown carbon nanofibers was cut into halves and put in a vacuum chamber of an electron microscope, an analysis was conducted for a side surface, and the results are shown in FIG. 2.

Referring to FIG. 2(*a*), the carbon nanofibers were found to be grown up to 2 mm, and referring to FIG. 2(*b*), their thickness was found less than or equal to approximately 40 nm.

Experiment 2

Transmission Electron Microscopy Analysis of Carbon Nanofibers about 3 mg of the carbon nanofibers were extracted and put in 5 ml dimethylene formamide, and ultrasonic dispersion proceeded for about 1 hour to prepare a solution in which the carbon nanofibers were dispersed. Subsequently, after a sample holder of a transmission electron microscope was soaked in the solution containing the dispersed carbon nanofiber and then taken and dried, analysis was conducted using a transmission electron microscope, and the results are shown in FIG. 3.

Referring to FIGS. 3(*a*) and (*b*), it was found that a catalyst observed at tip ends of carbon nanofibers grown by a traditional growth method was not observed, and accordingly, it can be seen that the carbon nanofibers were grown by base growth. Further, it can be seen that the carbon nanofibers had tip ends with a radius of curvature even smaller than traditional other carbon nanofibers.

FIG. 3(*d*) is an energy dispersive X-ray (EDX) graph showing elemental analysis of the carbon nanofibers of the present disclosure, and referring to the drawing, it can be seen that no higher indexed element than carbon was detected except copper (Cu) from TEM grid.

Experiment 3

Raman Spectroscopy Analysis of Carbon Nanofibers

Figure 4:
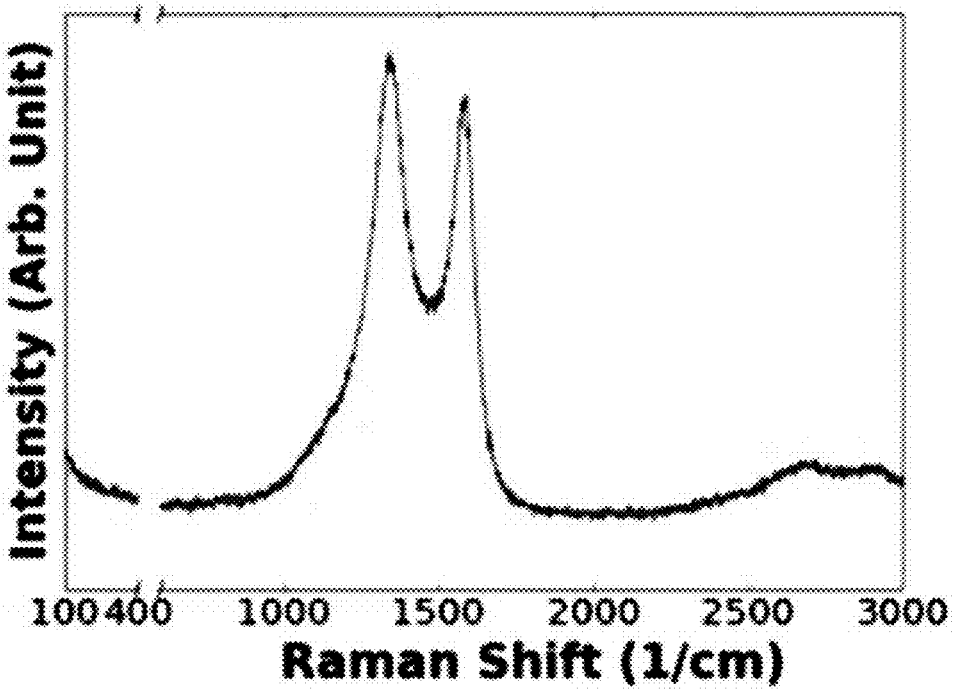
FIG. 4 is a Raman spectroscopy graph of carbon nanofibers prepared according to one embodiment of the present disclosure.

For the cut carbon nanofibers substrate obtained in the experiment 1 which is vertically placed, spectroscopy data acquired using Raman spectrum is shown in FIG. 4.

Referring to FIG. 4, the presence of a graphite layer was detected from a G band located in 1,582 $cm^{-1}$.

Experiment 4

Thermogravimetric Analysis of Carbon Nanofibers

Figure 5:
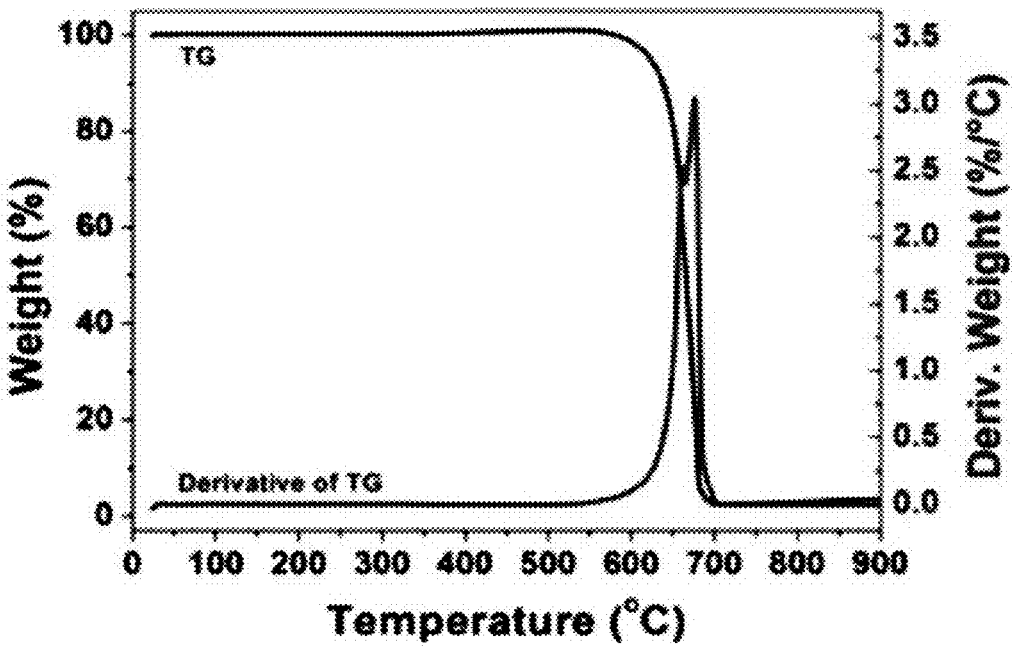
FIG. 5 is a thermogravimetric analysis graph of carbon nanofibers prepared according to one embodiment of the present disclosure.

For the solution containing the dispersed carbon nanofibers prepared in the experiment 2, analysis results using a thermogravimetric analysis method are shown in FIG. 5.

Referring to FIG. 5, it was found that carbon with considerably uniform crystallinity was formed without non-crystalline carbon.

The hereinabove described disclosure is provided to describe the technical features of the present disclosure for illustration only, and it is obvious to those skilled in the art that various changes and modifications may be made without departing from the essential features of the present disclosure. Therefore, it should be understood that the embodiments disclosed in the present disclosure is not intended to limit the technical features of the present disclosure, and the scope of the technical features of the present disclosure is not limited by such embodiments. The scope of protection of the present disclosure should be construed by the appended claims, and all technical features within its equivalent scope shall be construed as being included in the scope of the present disclosure.

What is claimed is:

1. A carbon nanofibers growth method comprising:

(S1) depositing an alumina layer on a silicon substrate;

(S2) depositing palladium on the alumina layer to form a palladium catalyst layer; and (S3) growing carbon nanofibers on the palladium catalyst layer by a chemical vapor deposition (CVD) method, wherein at the step (S3), the carbon nanofibers are grown by base growth, and the carbon nanofibers have tip ends with a radius of curvature less than or equal to 5 nm, a diameter less than or equal to 50 nm, a length more than or equal to 1 mm, and a length diameter aspect ratio more than or equal to 50,000.

2. The carbon nanofibers growth method according to claim 1, wherein the alumina layer is deposited with a thickness larger than or equal to 5 nm.

3. The carbon nanofibers growth method according to claim 1, wherein the palladium catalyst layer is formed with a thickness of from 0.5 nm to 5 nm.

4. The carbon nanofibers growth method according to claim 1, between the step S2 and the step S3, further comprising:

removing impurities created on the palladium catalyst layer.

5. The carbon nanofibers growth method according to claim 1, between the step S2 and the step S3, further comprising:

granulating the deposited palladium.

6. The carbon nanofibers growth method according to claim 5, wherein the granulating of the deposited palladium comprises mixing and supplying hydrogen gas and argon gas to the deposited palladium, and heating at temperature of from 500° C. to 800° C. in a vacuum or normal pressure condition.

7. The carbon nanofibers growth method according to claim 1, wherein the step S3 is performed in a vacuum or normal pressure condition with a carbon source, hydrogen gas and argon gas mixed and supplied to the deposited palladium.

8. The carbon nanofibers growth method according to claim 7, wherein the carbon source is any one selected from the group consisting of ethylene gas, methane gas, acetylene gas, benzene, acetone, and alcohol, or mixtures thereof.

9. The carbon nanofibers growth method according to claim 7, wherein the step S3 is performed in a heated state at temperature of from 600° C. to 900° C.

10. The carbon nanofibers growth method according to claim 9, wherein the heating is performed by any one selected from inductive heating, microwave heating, plasma heating, resistance heating, and laser heating.

* * * * *